US005549160A

United States Patent [19]

Bownes et al.

[11] Patent Number: 5,549,160

[45] Date of Patent: Aug. 27, 1996

[54] DOWNHOLE PROGRESSING CAVITY PUMP ROTOR VALVE

[75] Inventors: Dan Bownes, Hayter; Darren Wiltse, Calgary, both of Canada

[73] Assignee: National-Oilwell Canada Ltd., Canada

[21] Appl. No.: 249,944

[22] Filed: May 27, 1994

[51] Int. Cl.[6] ..... E21B 47/10

[52] U.S. Cl. ..... 166/250.08; 166/68.5; 166/106; 418/48; 418/182

[58] Field of Search ..... 166/68.5, 77.5, 166/105, 106, 108, 112, 369, 252; 418/48, 182

[56] References Cited

U.S. PATENT DOCUMENTS

| | | | |
|---|---|---|---|
| 3,938,744 | 2/1976 | Allen | 241/46.11 |
| 4,592,427 | 6/1986 | Morgan | 166/369 |
| 4,781,536 | 11/1988 | Hicks | 417/12 |
| 5,015,162 | 5/1991 | Heppner | 418/48 |
| 5,143,153 | 9/1992 | Bach et al. | 166/68.5 |

FOREIGN PATENT DOCUMENTS

| | | |
|---|---|---|
| 1097214 | 3/1981 | Canada . |
| 1165226 | 4/1984 | Canada . |
| 1207226 | 7/1986 | Canada . |
| 1285863 | 7/1991 | Canada . |

*Primary Examiner*—Ramon S. Britts
*Assistant Examiner*—Frank S. Tsay
*Attorney, Agent, or Firm*—Howell & Haferkamp, L.C.

[57] ABSTRACT

An apparatus and method for plugging a tubing string of a fluid producing well below a sucker rod driven progressing cavity type pump uses a valve means inside of the tubing string below the pump, the valve means being actuatable by displacing the rotor of the pump axially within the stator by vertical movement of the sucker rod string. The valve means can comprise a valve seat fixed to the inside of the tubing below the rotor and a valve member fixed to the bottom end of the rotor and adapted to be brought into sealing engagement with the valve seat by downward movement of the rotor.

14 Claims, 1 Drawing Sheet

DOWNHOLE PROGRESSING CAVITY PUMP ROTOR VALVE

BACKGROUND OF THE INVENTION

The present invention relates to a method and apparatus for pressure testing production tubing in a producing well having a downhole progressing cavity pump.

It is common practice to use a downhole pump to provide artificial lift to bring oil to the surface of a producing well after reservoir pressure has declined to the point where the well will no longer produce by natural energy. One form of downhole pump commonly used is the progressing cavity pump (PCP). The PCP is considered to be a positive displacement pump which is actuated by rotary motion. It consists of a single helical rotor rolling eccentrically in a double threaded helical stator of twice the pitch length. When actuated, the PCP produces fluid in a nonpulsating, continuous flow fashion and is approximately twice as efficient as a reciprocating rod pump.

A conventional oilwell installation incorporates the stator of a PCP to the production tubing string. The rotor is driven by a sucker rod string which is connected at its lower end to the rotor and extends inside the production tubing up to the surface. The sucker rod string is driven in rotary fashion by a surface drive head actuating the PCP.

Because the rotor of a PCP rolls in an eccentric motion inside the stator, this eccentric motion is imparted to the sucker rod string causing it to contact the inside walls of the production tubing, often producing a leak. For this reason, oilwell operators routinely pressure test the production tubing of wells fitted with a PCP for leaks.

The typical method for pressure testing production tubing requires the sucker rod string with rotor to be pulled out of the oilwell. A pressure actuated dart is pumped down the tubing until it seats inside a seating nipple formed on the inside walls of the production tubing above the PCP stator. With the dart in sealing engagement with the seating nipple, fluid is then pumped into the tubing and the pressure is allowed to build up. Loss of pressure indicates a leak and the tubing string must be pulled and repaired. If there are no leaks, a fishing tool is run into the well on a wireline, the dart is withdrawn, the sucker rod string and rotor is run back in the well and pumping is recommenced.

Production tube pressure testing is costly. It requires a service rig to be brought to the well head and a derrick erected to withdraw the sucker rod string. Not only are the rig costs considerable, but because the overall down-time of the well during testing is about 6–8 hours, a substantial loss of revenue is involved. In addition, the requirement to pull out and run in the sucker rod string each time testing is carried out causes wear on the sucker rod couplings.

SUMMARY OF THE INVENTION

The present invention provides a method and apparatus which allows production tubing pressure testing to be carried out without the requirement to remove the sucker rod string and PCP rotor from the well and without the need for the use of a pressure actuated dart or other externally introduced valve means. The present invention uses a valve mounted in the production tubing below the PCP. The valve can be closed by lowering the sucker rod string causing the rotor to move axially downward in the stator. With the valve actuated, fluid is pumped into the production tubing and pressure is allowed to build up in the tubing to test for leaks.

If there are no leaks, the sucker rod sting is lifted returning the rotor to its pumping position in the stator and the pump is brought back on line.

Thus in accordance with the present invention, there is provided an apparatus for plugging a tubing string of a fluid producing well below a pump of the type having a stator fixed to the inside of the tubing string wall and a rotor driven in rotary fashion within said stator by a sucker rod string, said rotor capable of being displaced axially within said stator by vertical movement of said sucker rod string, said apparatus comprising a valve means inside of the tubing string below said pump, said valve means being in an open position permitting fluid in the tubing string below said valve means to communicate therethrough into the tubing string above said valve means when said rotor is positioned within said stator and actuatable to a closed position preventing said fluid communication by downward axial movement of the rotor.

In accordance with another aspect of the invention, there is provided a method for plugging a tubing string of a fluid producing well below a pump of the type having a stator fixed to the inside of the tubing string wall and a rotor driven in rotary fashion within said stator by a sucker rod string, said rotor capable of being displaced axially within said stator by vertical movement of said sucker rod string, said apparatus comprising providing a valve means inside the tubing string below said pump, said valve means being in an open position permitting fluid in the tubing string below said valve means to communicate therethrough into the tubing string above said valve means when said rotor is positioned within said stator, and actuatable to a closed position preventing said fluid communication by downward axial movement of the rotor; manipulating said sucker rod string to axially displace said rotor downward to actuate said valve means.

In accordance with another aspect of the invention, there is provided a method for pressure testing a tubing string of a fluid producing having a progressing cavity pump of the type having a stator fixed to the inside of the tubing string wall and a rotor driven in rotary fashion within said stator by a sucker rod string, said rotor capable of being displaced axially within said stator by vertical movement of said sucker rod string, said apparatus comprising providing a valve means inside the tubing string below said pump, said valve means being in an open position permitting fluid in the tubing string below said valve means to communicate therethrough into the tubing string above said valve means when said rotor is positioned within said stator, and actuatable to a closed position preventing said fluid communication by downward axial movement of the rotor; lowering said sucker rod string to axially displace said rotor downward to actuate said valve means to the closed position; pumping test fluid into the tubing string above said valve means; monitoring the pressure in said tubing string; and raising said sucker rod string to axially displace said rotor upward to actuate said valve means to the open position.

DESCRIPTION OF THE PREFERRED EMBODIMENT

Figure 1:
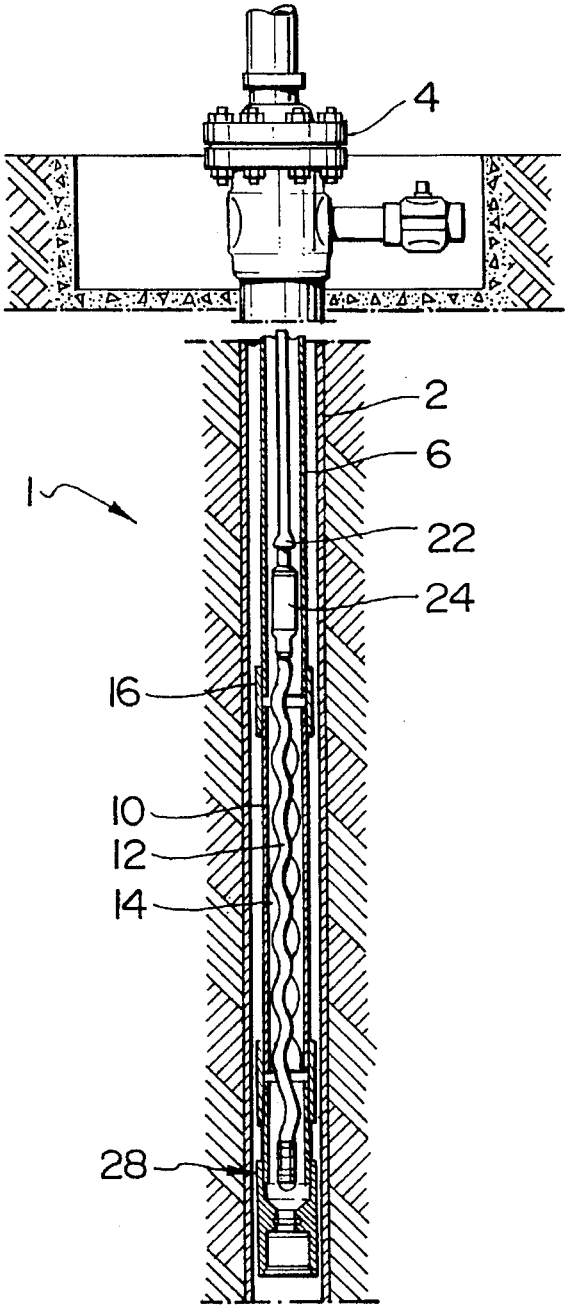
FIG. 1 is a part sectional side view illustrating a downhole application of a sucker rod string driven progressing cavity pump having the rotor valve of the present assembly.

Referring to FIG. 1, a downhole application of a progressing cavity pump is shown. A well, generally indicated by numeral 1, has casing 2 extending downwardly from well head 4 and is perforated at its lower end to permit formation fluid to pass into the casing. Production tubing string 6 extends down from well head 4 inside casing 2 and is open at its lower end to permit formation fluid inside casing 2 to be conducted inside production tubing string 6 to the surface. Packer 8 seals the annulus between casing 2 and production tubing string 6.

Progressing cavity pump 10 is positioned near the bottom of production tubing string 6 and comprises rotor 12 and stator 14. Rotor is a single threaded helix typically formed of steel and having a chrome or otherwise polished surface. Stator 14 is typically made of a hard rubber elastomer and has formed therein a double threaded helical cavity having twice the pitch length of rotor 12. Stator 14 is fixed at its upper end to production tubing string 6 by coupling 16. Sucker rod string 22 extends down from well head 4 inside production tubing string 6 and is connected at its lower end to the upper end of rotor 12 by means of coupling 24. The upper end of sucker rod string 22 is driven in rotary fashion by a conventional surface drive head (not shown) causing rotor 12 to turn in stator 14 and pump formation fluid up production tubing string 6 in a non-pulsating continuous flow.

The geometry of the PCP causes rotor 12 to roll eccentrically in stator 14. This imparts an eccentric whipping motion to sucker rod string 22 and causes sucker rod string 22 to contact the inside wall of production tubing string 6. After prolonged operation, this contact can wear a hole in production tubing string 6 with the result that formation fluid will leak into the annular space between production tubing string 6 and casing 2. In order to pressure test production tubing string 6 for leaks, it is necessary to develop a pressure differential between production tubing string 6 and casing 2. An adequate pressure differential cannot be developed between the inlet and outlet ends of a progressing cavity pump when it is not working because pressure test fluid pumped down production tubing string 6 will leak between rotor 12 and elastomeric stator 14 and will escape out the lower end of production tubing string 6 into the annular space between production tubing string 6 and casing 2. In order to prevent such escape of pressure testing fluid such that the required pressure differential can be developed, a valve assembly, generally indicated by numeral 28, is provided immediately below PCP 10.

Figure 2:
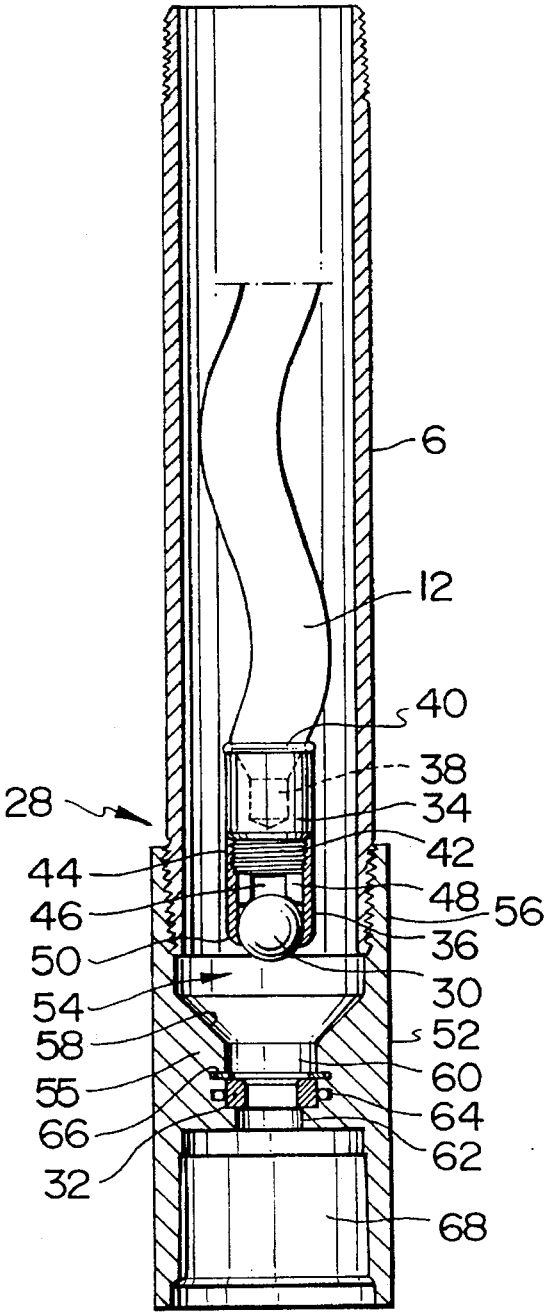
FIG. 2 is a sectional side view of the PCP rotor valve of the present invention.

With reference to FIG. 2, valve assembly 28 comprises valve ball 30 and valve seat 32. Valve ball 30 is mounted on the lower end of PCP rotor 12 by means of pin 34 and cage 36. Upwardly opening socket 38 is formed in the upper end of pin 34 and is shaped so as to closely receive the lower end of rotor 12. Pin 34 is securely fastened to rotor 12, for example by welding at upper edge 40. Pin 34 has formed thereon externally threaded projection 42 at its lower end. Cage 36 is a hollow cylindrical element with an internally threaded upper portion 44 adapted to be received on externally threaded projection 42. Downwardly opening socket 46 is formed in the lower end of cage 36 and houses valve ball 30 and ball seat 48. The lower sidewall edge portion 50 of cage 36 is deflected inwardly to position and retain valve ball 30 against seat 48.

Valve seat 32 is mounted in collar 52 in axial alignment with the center of production tubing string 6. Collar 52 has an upwardly opening cavity 54 which is internally threaded at its upper portion 56 for connection to the lower portion of production tubing string 6. The base 55 of cavity 54 has guide surface 58 which slopes downwardly and inwardly toward centrally disposed valve seat recess 60. Valve seat 32 is positioned and retained on inwardly projecting shoulder 62 by O-ring 64 and retainer 66. Downwardly opening socket 68 is formed in the lower portion of collar 52 and is internally threaded to permit other elements to be connected to production tubing string 6 if required.

Valve ball 30 and valve seat 32 can be manufactured from a number of alternative materials so long as the materials-selected are sufficiently strong to withstand the substantial pressure developed on their respective mating surfaces by the weight of sucker rod string 22. It has been found that conventional 440C stainless steel ball and tungsten carbide seat valve components typically used in reciprocating sucker rod pump applications can be used in the present invention.

During pumping operations operation, PCP 10 acts in a conventional manner. Rotor 12 is turned by sucker rod string 22 inside stator 14 and causes formation fluid to be pumped upward through production tubing string 6 to the surface. When it is desired to pressure test production tubing string 6 for leaks, sucker rod string 22 is simply lowered until valve ball 30 is seated in valve seat 32. While being lowered, rotor 12 tends to wobble laterally in stator 14 and guide surface 58 serves to direct valve ball 30 into sealing engagement with valve seat 32. When valve ball 30 is in sealing engagement with valve seat 32, fluid communication between the inside of production tubing string 6 and the annular space between production tubing string 6 and casing 2 is prevented. Ball seat 48 transfers the thrust from pin projection 42 to valve ball 30. Valve seat 32 takes up the entire weight of sucker rod string 22, providing indication at the surface that the well is ready to be pressure tested. Pressure testing is carried out by pumping test fluid into production tubing string 6 and monitoring pressure buildup in a manner that is well known in the art.

Pressure testing a production tubing string in accordance with the present invention offers numerous advantages over conventional methods. In conventional methods, the overall well downtime while the sucker rod string is removed, the pressure actuated dart is pumped down the production tubing string, the tubing is pressurized, the dart is fished out and the sucker rod string is run back in, is approximately 6–8 hours. Not only does this involve significant loss of production time, but also usually requires the hiring of a service rig to perform the operation. In contrast, pressure testing in accordance with the method of the present invention can usually be completed in about ½ hour, without the use of a service rig. Furthermore, because the present invention does not require the sucker rod string to be withdrawn and run back in, wear and breakage of the sucker rod couplings when breaking down and making up the string is greatly reduced.

While certain preferred embodiments of the invention have been disclosed for the purpose of illustration, numerous changes in the arrangement and construction of parts and steps may be made by those skilled in the art without departing from the scope of the invention.

What is claimed is:

1. An apparatus for plugging a tubing string of a fluid producing well below a pump of the type having a stator fixed to the inside of the tubing string wall and a rotor driven in rotary fashion within said stator by a sucker rod string, said rotor capable of being displaced axially within said stator by vertical movement of said sucker rod string, said apparatus comprising a valve means inside of the tubing string below said pump, said valve means being in an open position permitting fluid in the tubing string below said valve means to communicate therethrough into the tubing string above said valve means when said rotor is positioned within said stator and actuatable to a closed position preventing said fluid communication by downward axial movement of the rotor.

2. The apparatus of claim 1 wherein the pump is a progressing cavity pump and the valve means comprises a valve seat fixed to the inside of the tubing below said rotor; a valve member fixed to the bottom end of the rotor; said valve member adapted to be brought into sealing engagement with said valve seat by downward axial movement of the rotor.

3. The apparatus of claim 2 wherein the valve seat comprises an annular seat surface disposed around a central bore and the valve member is a valve ball.

4. The apparatus of claim 3 wherein the annular seat is formed of tungsten carbide and the valve ball is formed of stainless steel.

5. The apparatus of claim 2 wherein the valve means comprises a valve seat assembly and a valve member assembly; said valve seat assembly comprising a body portion having a generally cylindrical sidewall and a lower transverse base defining an upwardly opening cavity, attachment means at the upper end of said sidewall for fluid tight attachment to the lower end of said tubing, a centrally disposed bore extending down through the base of said cavity and an upward facing annular valve seat surface disposed about said bore; said valve member assembly comprising an upper pin section, a lower cage section and a valve ball, said upper pin section adapted to be fixed to the bottom end of said rotor and having a downwardly extending externally threaded cylindrical projection; said lower cage section having a hollow tubular shape, the sidewall thereof being internally threaded at its upper end for connection to said externally threaded cylindrical projection and extending below the bottom of the cylindrical projection and being deflected inwardly at its lower edge so as to define an internal downwardly opening cavity; said valve ball being disposed in said downwardly opening cavity and having a diameter greater than that of the lower edge of the sidewall of said cage section so as to be retained therein; whereby downward movement of said rotor causes said valve ball to sealingly engage said annular valve seat surface.

6. The apparatus of claim 5 further comprising downwardly and inwardly sloping guide surfaces in the body portion of said valve seat assembly effective to guide the valve ball into sealing engagement with the annular valve seat surface.

7. The apparatus of claim 5 wherein the annular valve seat surface is formed of tungsten carbide and the valve ball is formed of stainless steel.

8. The apparatus of claim 5 further comprising an annular ball seat surface disposed in said downwardly opening cavity for transferring downward thrust from said cylindrical projection to said valve ball.

9. A method for plugging a tubing string of a fluid producing well below a pump of the type having a stator fixed to the inside of the tubing string wall and a rotor driven in rotary fashion within said stator by a sucker rod string, said rotor capable of being displaced axially within said stator by vertical movement of said sucker rod string, said method comprising providing a valve means inside the tubing string below said pump, said valve means being in an open position permitting fluid in the tubing string below said valve means to communicate therethrough into the tubing string above said valve means when said rotor is positioned within said stator, and actuatable to a closed position preventing said fluid communication by downward axial movement of the rotor; manipulating said sucker rod string to axially displace said rotor downward to actuate said valve means.

10. The method of claim 9 wherein the step of providing the valve means includes providing a valve seat fixed to the inside of the tubing below said rotor and providing a valve member fixed to the bottom end of the rotor and wherein the step of manipulating said sucker rod string causes said valve member to be brought into sealing engagement with said valve seat by downward movement of the rotor.

11. The method of claim 10 wherein the step of providing a valve seat includes providing an annular seat surface disposed around a central bore and the step of providing a valve member includes providing a valve ball.

12. A method for pressure testing a tubing string of a fluid producing having a progressing cavity pump of the type having a stator fixed to the inside of the tubing string wall and a rotor driven in rotary fashion within said stator by a sucker rod string, said rotor capable of being displaced axially within said stator by vertical movement of said sucker rod string, said method comprising providing a valve means inside the tubing string below said pump, said valve means being in an open position permitting fluid in the tubing string below said valve means to communicate therethrough into the tubing string above said valve means when said rotor is positioned within said stator, and actuatable to a closed position preventing said fluid communication by downward axial movement of the rotor; lowering said sucker rod string to axially displace said rotor downward to actuate said valve means to the closed position; pumping test fluid into the tubing string above said valve means; monitoring the pressure in said tubing string; and raising said sucker rod string to axially displace said rotor upward to actuate said valve means to the open position.

13. The method of claim 12 wherein the step of providing the valve means includes providing a valve seat fixed to the inside of the tubing below said rotor and providing a valve member fixed to the bottom end of the rotor and wherein the step of lowering said sucker rod string causes said valve member to be brought into sealing engagement with said valve seat by downward movement of the rotor.

14. The method of claim 13 wherein the step of providing a valve seat includes providing an annular seat surface disposed around a central bore and the step of providing a valve member includes providing a valve ball.

* * * * *